US011363846B2

(12) United States Patent
Wang

(10) Patent No.: US 11,363,846 B2
(45) Date of Patent: Jun. 21, 2022

(54) ADJUSTABLE TIGHTENING DEVICE

(71) Applicant: Meng-Chun Wang, Taichung (TW)

(72) Inventor: Meng-Chun Wang, Taichung (TW)

( * ) Notice: Subject to any disclaimer, the term of this patent is extended or adjusted under 35 U.S.C. 154(b) by 241 days.

(21) Appl. No.: 16/707,206

(22) Filed: Dec. 9, 2019

(65) Prior Publication Data

US 2021/0002096 A1 Jan. 7, 2021

(30) Foreign Application Priority Data

Jul. 5, 2019 (TW) ..... 108208781

(51) Int. Cl.
*A41F 1/00* (2006.01)

(52) U.S. Cl.
CPC ..... *A41F 1/008* (2013.01); *Y10T 24/2187* (2015.01)

(58) Field of Classification Search
CPC ... A61H 2011/005; A61F 5/028; B65G 23/44; B65H 23/18; B65H 2551/12; A41F 1/008; Y10T 24/2164; Y10T 24/2179; Y10T 24/2187; A42B 3/145
See application file for complete search history.

(56) References Cited

U.S. PATENT DOCUMENTS 9,380,824 B2 * 7/2016 Ma ..... A42B 3/145
2007/0266481 A1 * 11/2007 Alexander ..... A42B 3/145 2/414
2018/0209618 A1 * 7/2018 Pontano ..... F21V 21/0816
2018/0295733 A1 * 10/2018 Wen ..... H05K 5/0017

FOREIGN PATENT DOCUMENTS

KR 20120127814 A * 11/2012

* cited by examiner

*Primary Examiner* — Daniel J Colilla
(74) *Attorney, Agent, or Firm* — Muncy, Geissler, Olds & Lowe, P.C.

(57) ABSTRACT

An adjustable tightening device is provided, including: a fastening, an actuating member and a rotatable member. Wherein when the rotatable member is rotated toward a first direction, each abutting rib of the rotatable member is located in the third position, each of the two abutting ribs abuts against one of two elastic arms of the actuating member so that a ratchet is not meshed with an annular gearing portion of the fastening mechanism and a gear portion of the actuating member is rotatable toward the first direction; wherein when the rotatable member is rotated toward a second direction, each of the two abutting ribs is located in the fourth position, each of the two abutting ribs abuts against one of the two elastic arms so that the ratchet is meshed with the annular gearing portion and the gear portion is unidirectionally rotatable toward the second direction.

9 Claims, 13 Drawing Sheets

ADJUSTABLE TIGHTENING DEVICE

BACKGROUND OF THE INVENTION

Field of the Invention

The present invention relates to an adjustable tightening device.

Description of the Prior Art

In general, a device has an adjustable mechanism for adjustment to meet the physical requirements of users. A conventional protective device such as a waist-brace, as shown in patent TWD197021, is for supporting a waist portion and a back portion of a human body. The conventional protective device has two straps disposed on two opposite sides thereof, and each strap has a connection structure such as a Velcro, a buckle member or the like. The conventional protective device can be tied to the human body only by overlapping the two straps to connect the two connection structures with each other.

However, connection strength between the two connection structures is poor, so that the two straps are easy to disengage from each other.

The present invention is, therefore, arisen to obviate or at least mitigate the above mentioned disadvantages.

SUMMARY OF THE INVENTION

An object of the present invention is to provide an adjustable tightening device with quick adjustment for tightening or loosening a fastening mechanism.

To achieve the above and other objects, an adjustable tightening device is provided, including: a fastening mechanism, including a first band portion and at least one second band portion being movable relative to the first band portion, the first band portion including a through hole having an annular gearing portion, each of the at least one second band portion having a gearing track; an actuating member, disposed within the through hole, having a central shaft portion and two elastic arms, the central shaft portion having a gear portion protruding axially therefrom and movably meshing with the gearing track of the at least one second band portion, each of the two elastic arms radially extending away from the central shaft portion, the central shaft portion having two first restriction portions, each of two elastic arms having a ratchet disengageably meshed with the annular gearing portion, the ratchet being radially movable between a first position and a second position, each of the two first restriction portions being arranged separately from any of the two elastic arms; a rotatable member, connected with the actuating member, including two second restriction portions and two abutting ribs, each of the two abutting ribs being movable between a third position and a fourth position and abuttable against one of the two elastic arms, each of the two first restriction portions being an insertion hole, each of the two second restriction portions being a pin which is movably inserted within one said insertion hole; wherein when the rotatable member is rotated toward a first direction, each of the two abutting ribs is located in the third position, each of the two abutting ribs abuts against one of the two elastic arms so that the ratchet is not meshed with the annular gearing portion and the gear portion is rotatable toward the first direction; wherein when the rotatable member is rotated toward a second direction, each of the two abutting ribs is located in the fourth position, each of the two abutting ribs abuts against one of the two elastic arms so that the ratchet is meshed with the annular gearing portion and the gear portion is unidirectionally rotatable toward the second direction; wherein each of the two elastic arms and the central shaft portion defines a receiving hole, the receiving hole is noncommunicated with the two insertion holes, one of the two abutting ribs is engaged within one of the two receiving holes, each of the two insertion holes has two blocking walls disposed at two opposite sides thereof; wherein when each of the two abutting ribs is located in the third position and abut against one of the two elastic arms, each of the two pins abuts against one of the two blocking walls; wherein when each of the two abutting ribs is located in the fourth position and abuts against one of the two elastic arms, each of the two pins abuts against the other of the two blocking walls.

To achieve the above and other objects, an adjustable tightening device is further provided, including: a fastening mechanism, including a fastening mechanism, including a first band portion, the first band portion including a through hole with an annular gearing portion, each of the at least one second band portion having a gearing track; an actuating member, disposed within the through hole, having a central shaft portion and two elastic arms, the central shaft portion having a gear portion protruding axially therefrom and movably meshing with the gearing track of the at least one second band portion, each of the two elastic arms radially extending away from the central shaft portion, the central shaft portion having two first restriction portions, each of two elastic arms having a ratchet disengageably meshed with the annular gearing portion, the ratchet being radially movable between a first position and a second position, each of the two first restriction portions being arranged separately from any of the two elastic arms; a reel unit, connected with the central shaft portion of the actuating member, the reel unit being rotatable relative to the first band portion; a rotatable member, connected with the actuating member, including two second restriction portions and two abutting ribs, each of the two abutting ribs being movable between a third position and a fourth position and abuttable against one of the two elastic arms, each of the two first restriction portions being an insertion hole, each of the two second restriction portions being a pin which movably inserts within the insertion hole; wherein when the rotatable member is rotated toward a first direction, each of the two abutting ribs is located in the third position, each of the two abutting ribs abuts against one of the two elastic arms so that the ratchet is not meshed with the annular gearing portion and the reel unit is rotatable toward the first direction; wherein when the rotatable member is rotated toward a second direction, each of the two abutting ribs is located in the fourth position, each of the two abutting ribs abuts against one of the two elastic arms so that the ratchet is meshed with the annular gearing portion and the reel unit is unidirectionally rotatable toward the second direction; wherein each of the two elastic arms and the central shaft portion defines a receiving hole, the receiving hole is noncommunicated with the two insertion holes, one of the two abutting ribs is engaged within one of the two receiving holes, each of the two insertion holes has two blocking walls disposed at two opposite sides thereof; wherein when each of the two abutting ribs is located in the third position and abut against one of the two elastic arms, each of the two pins abuts against one of the two blocking walls; wherein when each of the two abutting ribs is located in the fourth position and abuts against one of the two elastic arms, each of the two pins abuts against the other of the two blocking walls.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
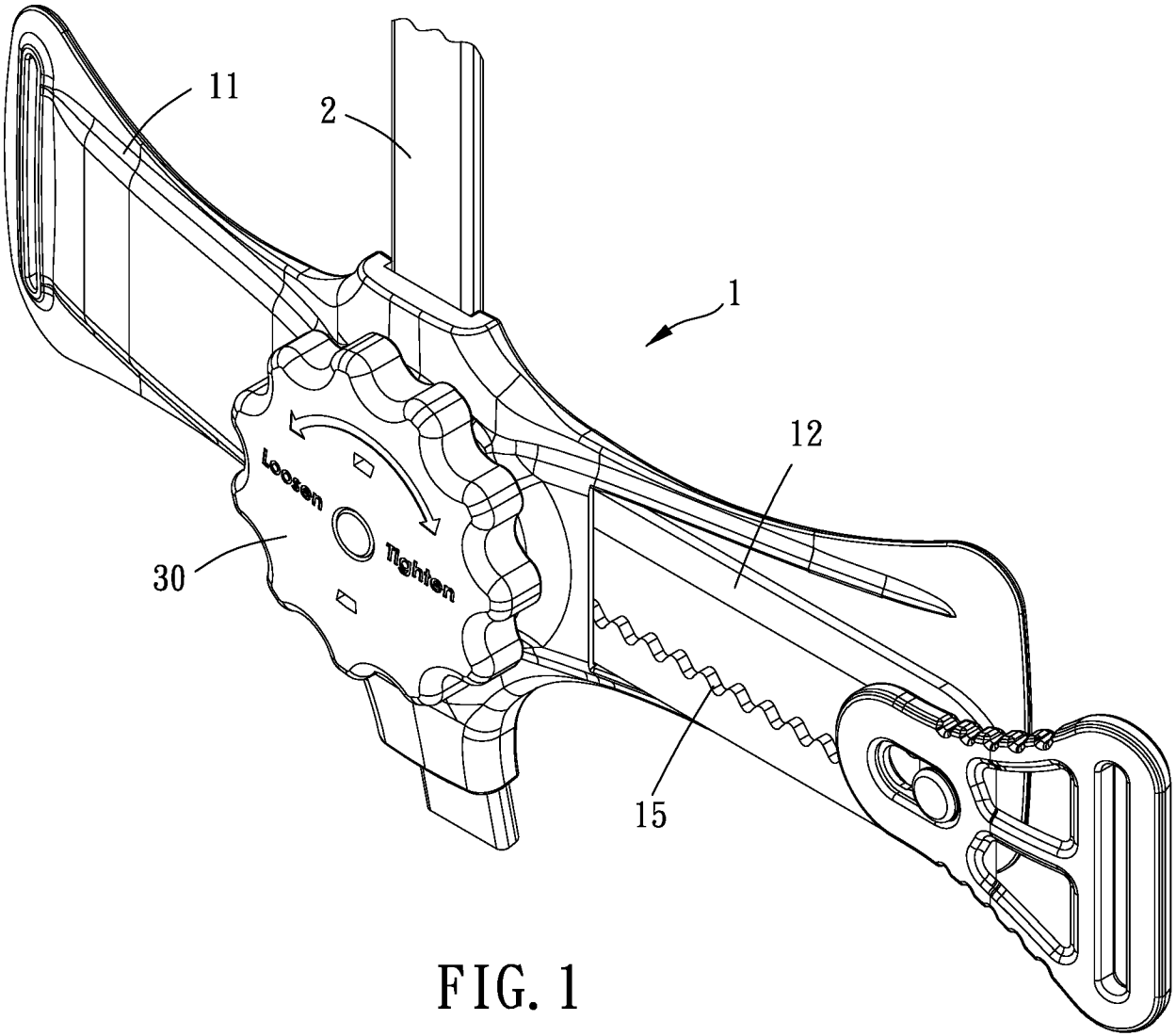
FIG. 1 is a perspective view of an adjustable tightening device according to a first preferred embodiment of the present invention.
Figure 2:
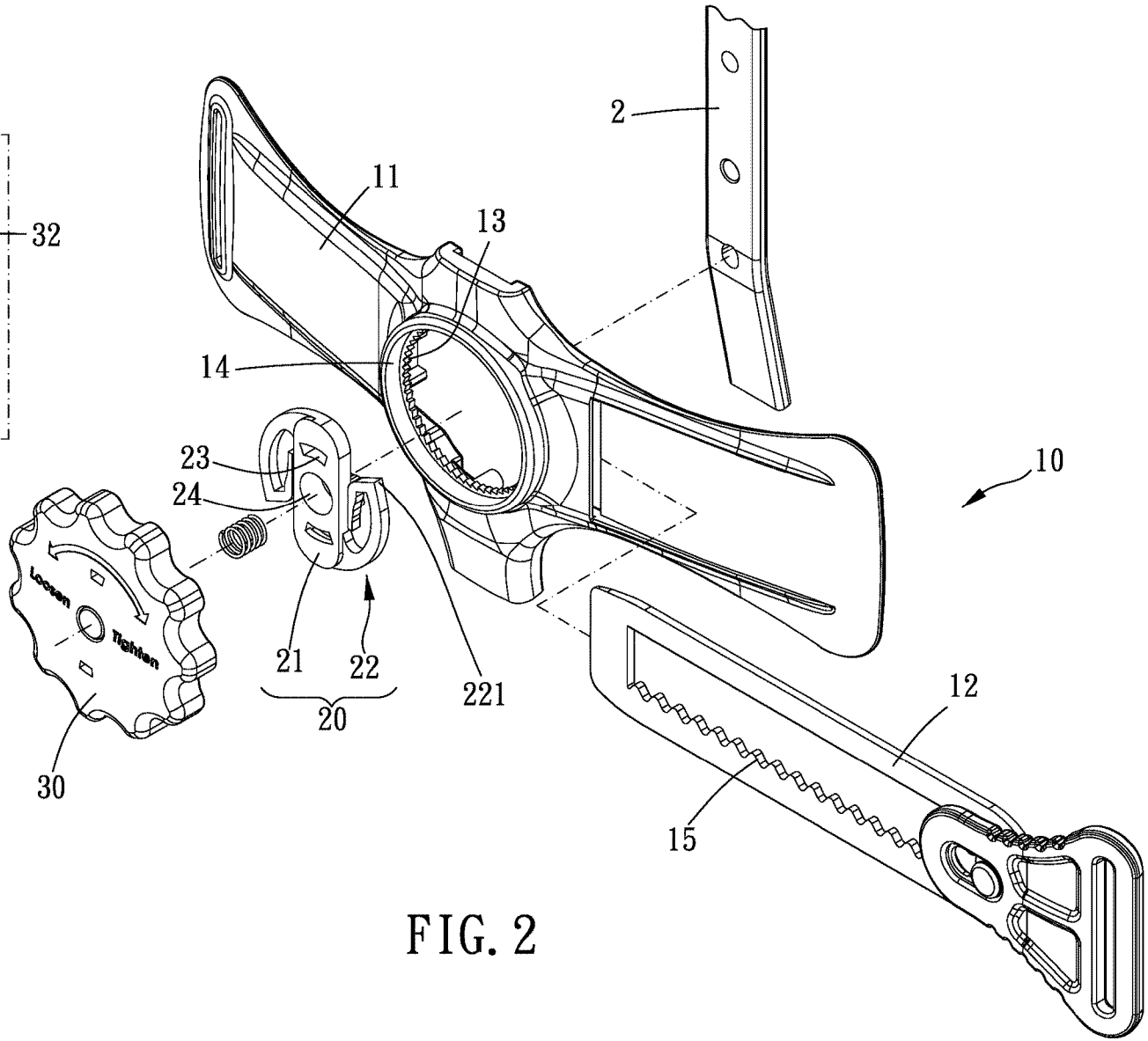
FIG. 2 is a breakdown drawing of the first preferable embodiment of the present invention.
Figure 2A:
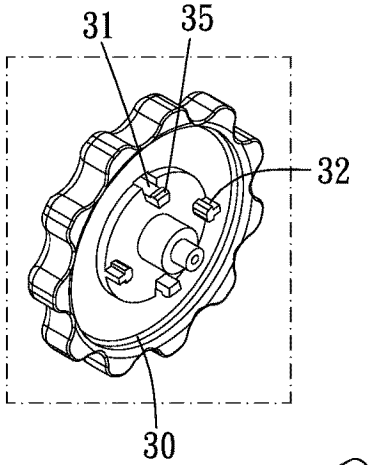
FIG. 2A is perspective view of a rotatable member of the first preferable embodiment of the present invention.
Figure 3:
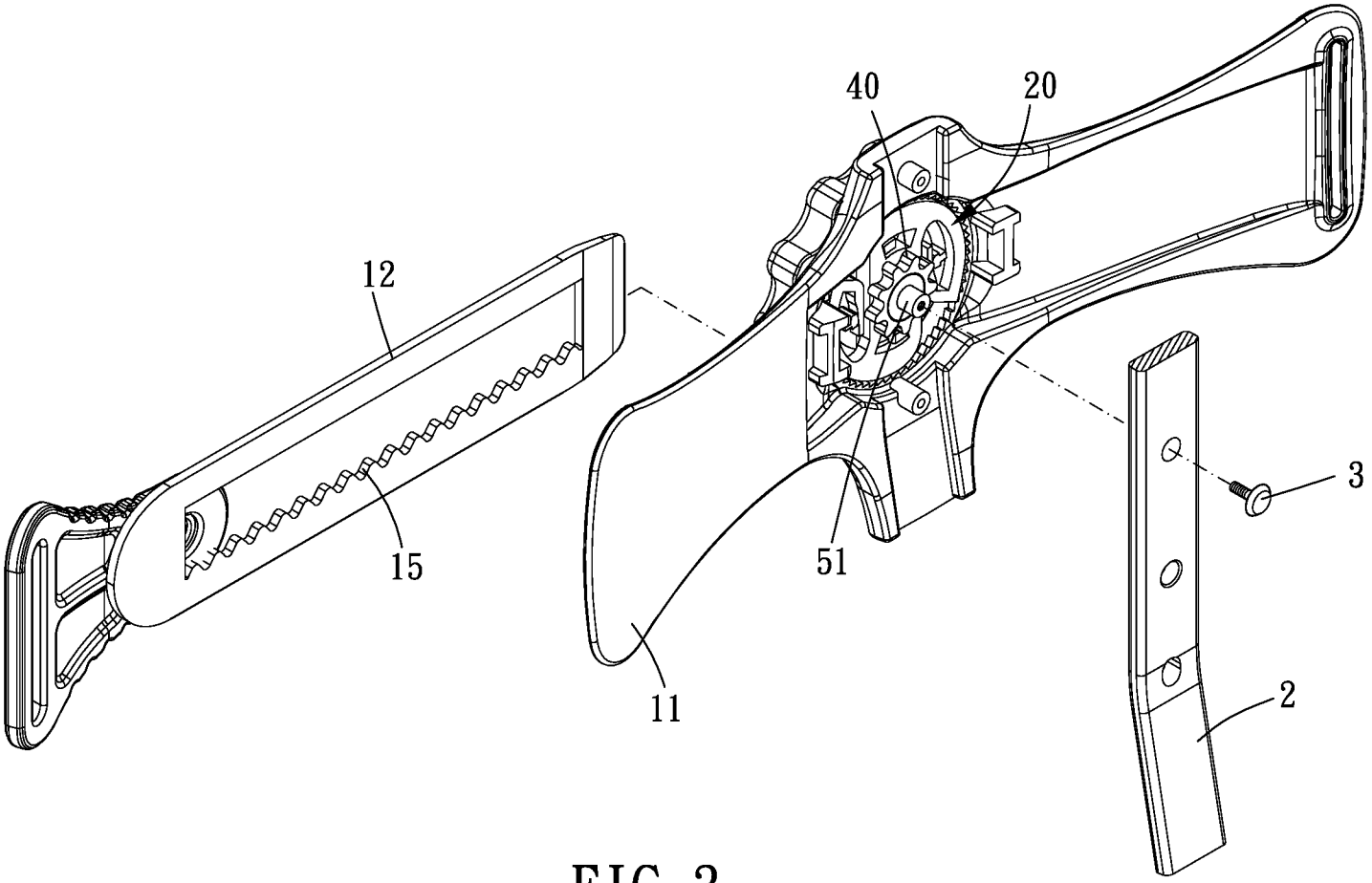
FIG. 3 is another breakdown drawing of the first preferable embodiment of the present invention.
Figure 4:
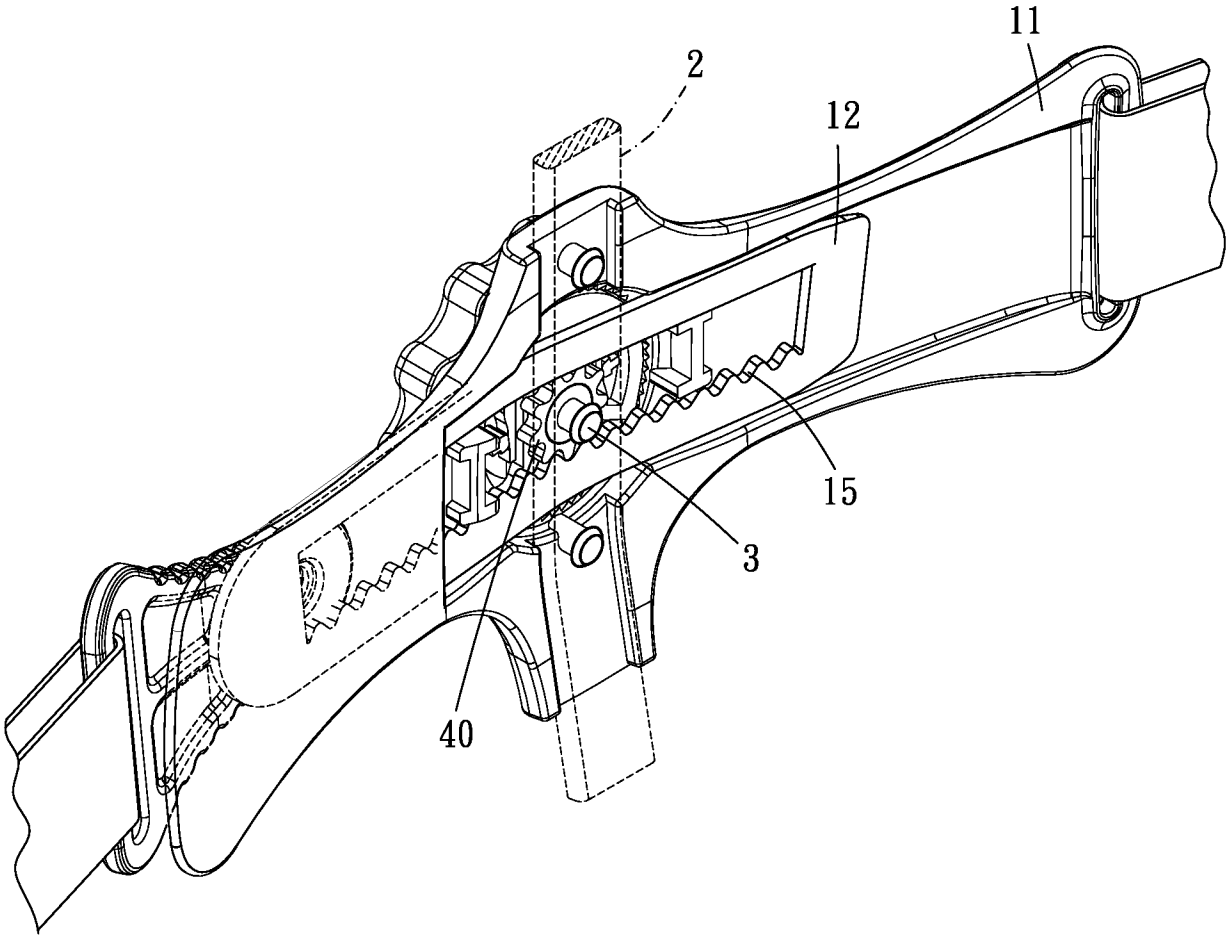
FIG. 4 is another perspective view of the first preferred embodiment of the present invention.
Figure 5:
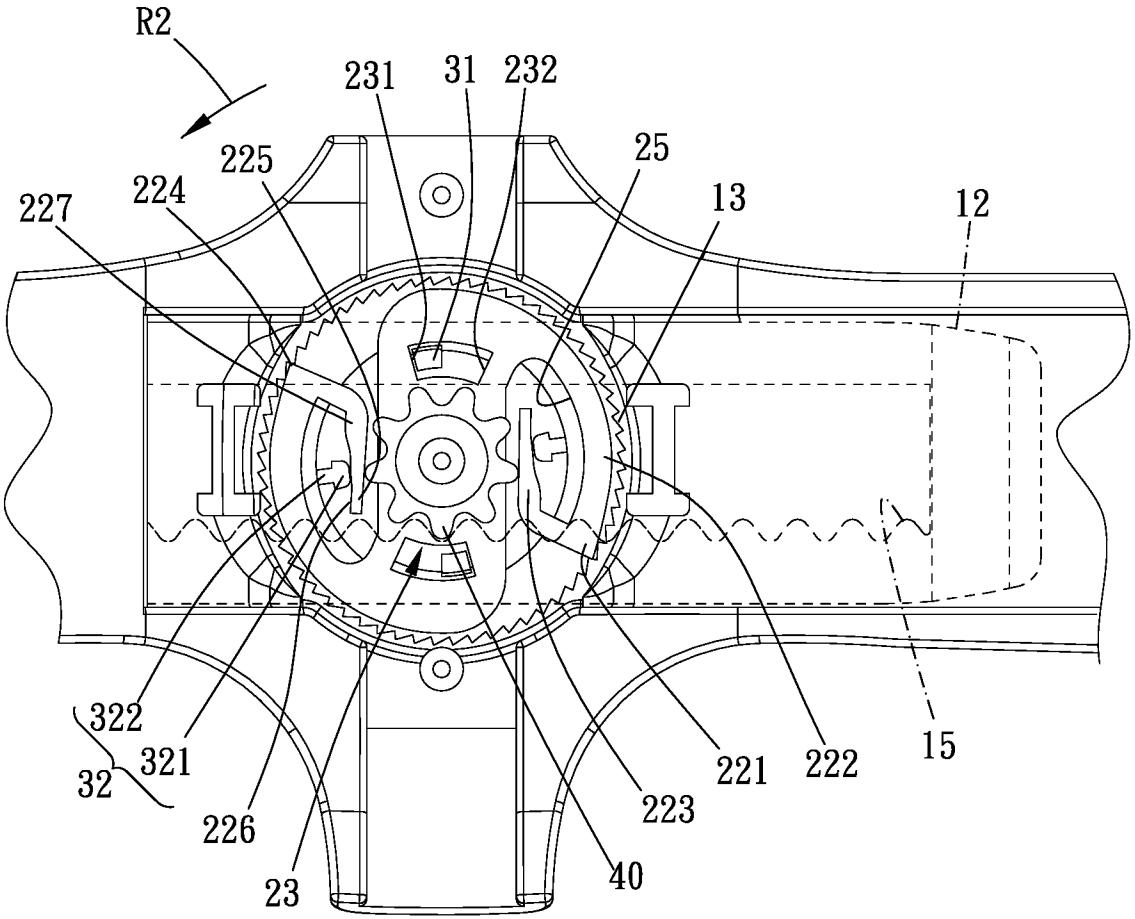
FIG. 5 is a drawing showing the rotatable member rotated toward a second direction of the first preferable embodiment of the present invention.
Figure 6:
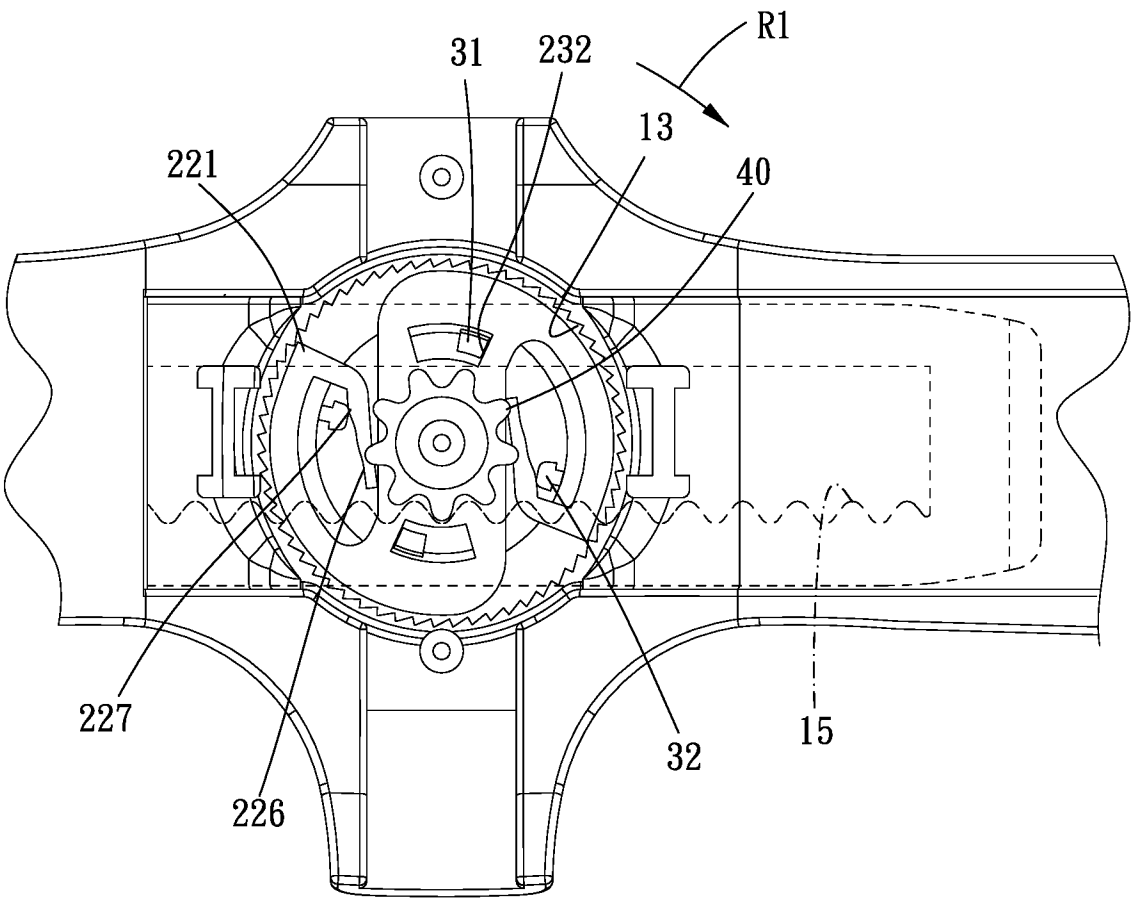
FIG. 6 is a drawing showing the rotatable member rotated toward a first direction of the first preferable embodiment of the present invention.
Figure 7:
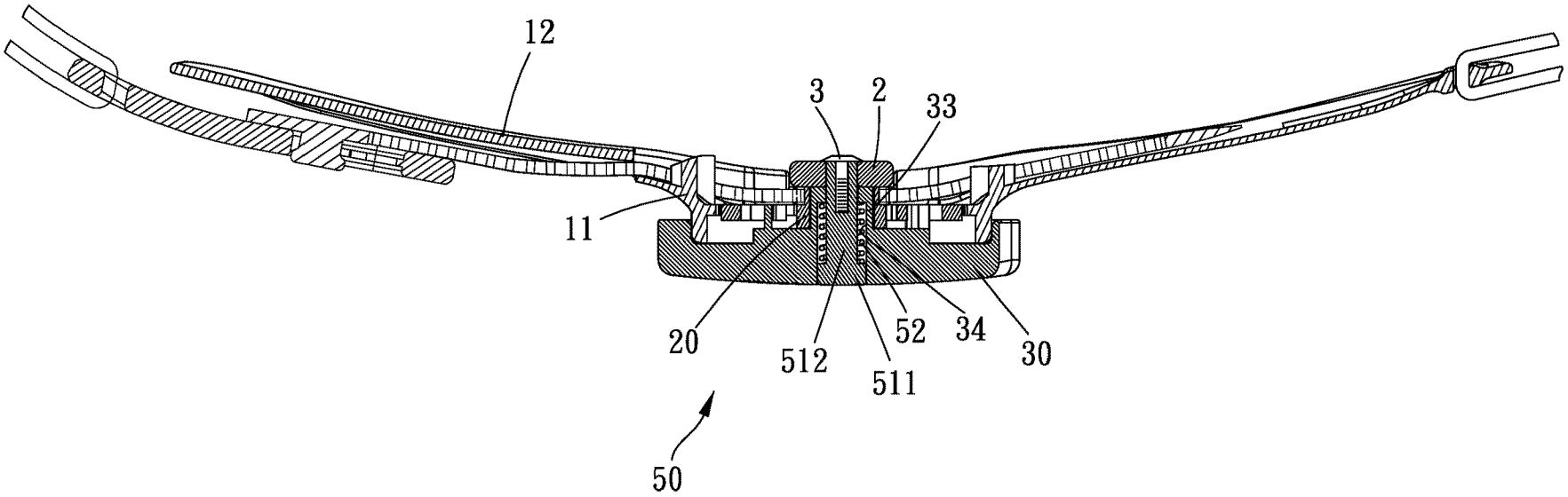
FIG. 7 is a cross-sectional view of the first preferable embodiment of the present invention.
Figure 8:
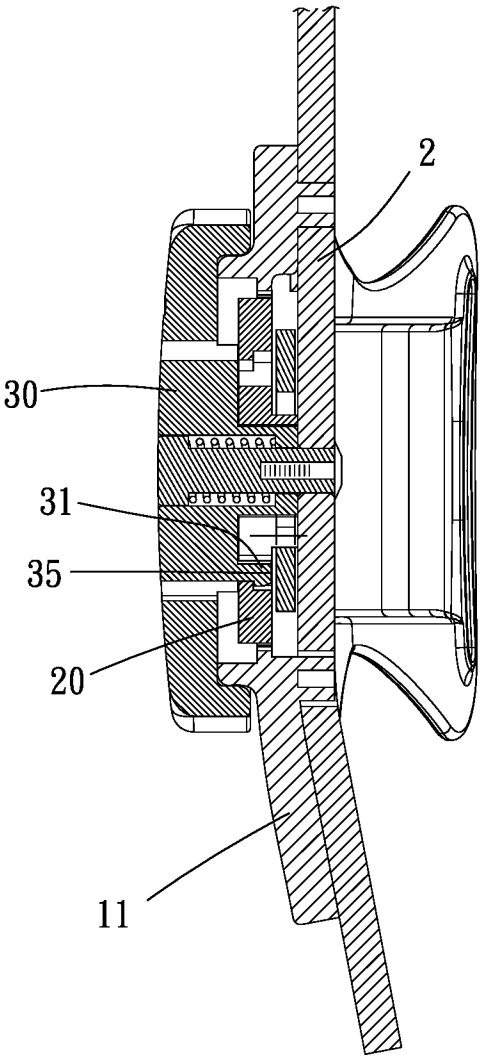
FIG. 8 is another cross-sectional view of the first preferable embodiment of the present invention.
Figure 9:
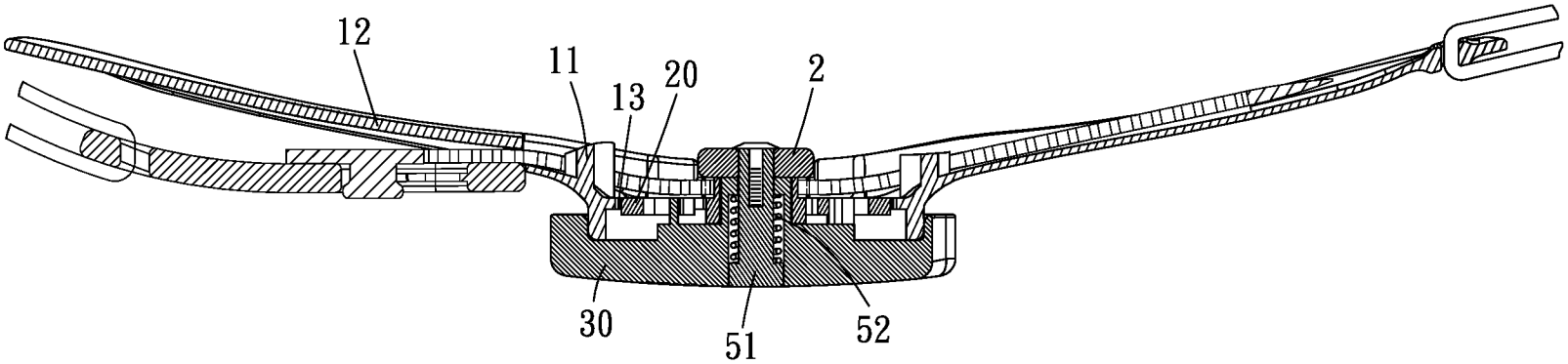
FIGS. 9-10 are drawings showing the first preferable embodiment of the present invention in use.
Figure 10:
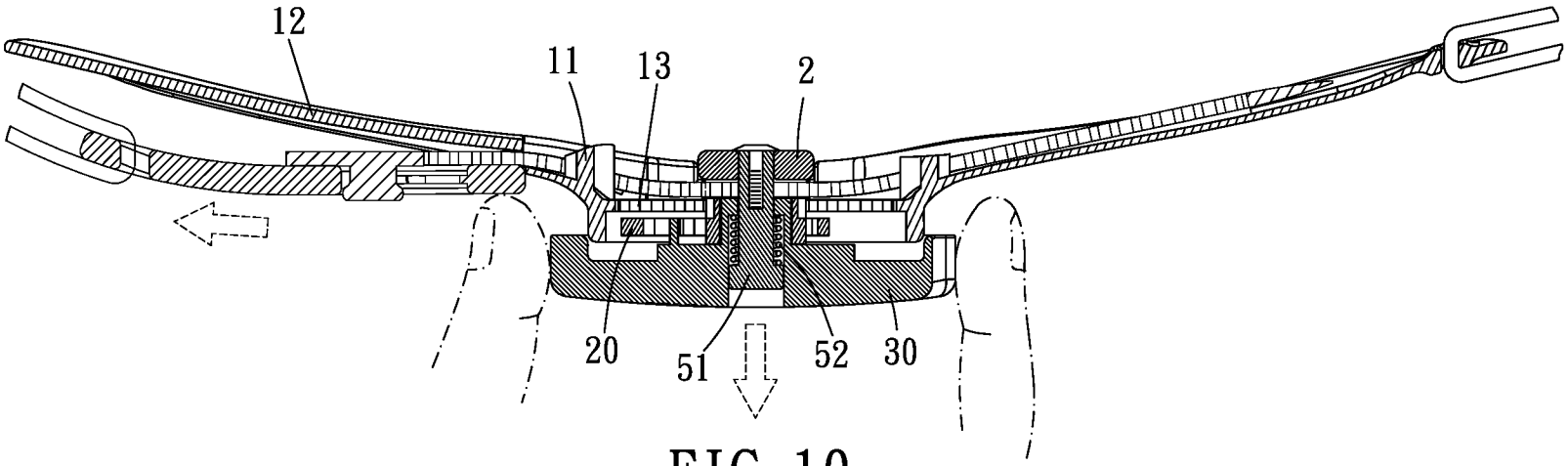

FIGS. 1-10 show an adjustable tightening device according to a first preferred embodiment of the present invention. The adjustable tightening device 1 includes a fastening mechanism 10, an actuating member 20 and a rotatable member 30.

The fastening mechanism 10 includes a first band portion 11 and at least one second band portion 12 being movable relative to the first band portion 11, the first band portion 11 includes a through hole 14 having an annular gearing portion 13, each of the at least one second band portion 12 has a gearing track 15.

The actuating member 20 is disposed within the through hole 14, the actuating member 20 has a central shaft portion 21 and two elastic arms 22, the central shaft portion 21 has a gear portion 40 protruding axially therefrom and movably meshing with the gearing track 15 of the at least one second band portion 12. Each of the two elastic arms 22 radially extends away from the central shaft portion 21. The central shaft portion 21 has two first restriction portions 23, Each of two elastic arms 22 has a ratchet 221 disengageably meshed with the annular gearing portion 221, the ratchet 221 is radially movable between a first position and a second position. Each of the two first restriction portions 23 is arranged separately from any of the two elastic arms 22. The rotatable member 30 is connected with the actuating member 20, and includes two second restriction portions 31 and two abutting ribs 32. Each of the two abutting ribs 32 is movable between a third position and a fourth position and abuttable against one of the two elastic arms 22, each of the two first restriction portions 23 is an insertion hole, and each of the two second restriction portions 31 is a pin which is movably inserted within one said insertion hole.

When the rotatable member 30 is rotated toward a first direction R1, each of the two abutting ribs 32 is located in the third position, each of the two abutting ribs 32 abuts against one of the two elastic arms 22 so that the ratchet 221 is located in the first position and not meshed with the annular gearing portion 13, and the gear portion 40 is rotatable toward the first direction R1; when the rotatable member 30 is rotated toward a second direction R2, each of the two abutting ribs 32 is located in the fourth position, each of the two abutting ribs 32 abuts against one of the two elastic arms 22 so that the ratchet 221 is located in the second position and meshed with the annular gearing portion 13 and the gear portion 40 is unidirectionally rotatable toward the second direction R2. Thus, the second band portion 12 can be moved relative to the first band portion 11 quickly, and can be stably fixed with the first band portion 11 to prevent being movable relative to the first band portion 11 easily.

The central shaft portion 21 of the actuating member 20 defines an axial direction, and the actuating member 20 defines a circumferential direction around the axial direction.

A center of the actuating member 20 is located on the axial direction, the two elastic arms 22 are disposed by two opposite sides of the axial direction, and the two abutting ribs 32 are disposed by two opposite sides of the axial direction for stable positioning and rotation.

Each of the two elastic arms 22 and the central shaft portion 21 defines a receiving hole 25, and the receiving hole 25 is noncommunicated with the two insertion holes. One of the two abutting ribs 32 is engaged within one of the two receiving holes 25. Each of the two insertion holes has two blocking walls 231, 232 disposed at two opposite sides thereof. When each of the two pins is moved within one said insertion hole, each of the two pins does not interfere with the two elastic arms 22 so that the each of the two elastic arms 22 can be stably meshed with the annular gearing portion 13. Wherein each of the two abutting ribs 32 is located in the third position and abuts against one of the two elastic arms 22, each of the two pins abuts against the blocking wall 231 so that the gear portion 40 is rotatable toward the second direction R2; when each of the two abutting ribs 32 is located in the fourth position and abuts against one of the two elastic arms 22, each of the two pins abuts against the blocking wall 232 so that the gear portion 40 is rotatable toward the first direction R1.

Each of the two elastic arms 22 has an external arm portion 222 and an internal arm portion 223. A connection portion 224 of the internal arm portion 223 is connected with the external arm portion 222, the internal arm portion 223 has a free end portion 225 disposed opposite to the connection portion 224. The external arm portion 222 has the ratchet 221. Each said internal arm portion 223 and one said external arm portion 222 define one said receiving hole 25 therebetween. One of the two abutting ribs 32 abuts against the internal arm portion 223, and the internal arm portion 223 has an abutted surface 226 facing the external arm portion 222. The abutted surface 226 includes a convex portion 227 protruding toward the external arm portion 222. When each of the two abutting ribs 32 is located in the third position, each of the two abutting ribs 32 abuts against the convex portion 227 so that the ratchet 221 is disengaged from the annular gearing portion 13; and when each of the two abutting ribs 32 is located in the fourth position, each of the abutting ribs 32 abuts against the abutted surface 226 so that the ratchet 221 is elastically meshed with the annular gearing portion 13. The free end portion 225 extends away from the connection portion 224, and an extent of the internal arm portion 223 is greater than ½ an extent of the external arm portion 222 in the circumferential direction, so as to increase a size of an abutted surface abutted by the abutting ribs 32, and provide resiliency.

As viewed in the axial direction, each of the two abutting ribs 32 extends radially and is mushroom-shaped. And each said abutting rib 32 has a head section 321 which is abutted against the internal arm portion 223 of one said elastic arm 22 and a body section 322 which is closer to the external arm portion 222 of one said elastic arm 22 than the head section 321, thus being easy to abutted against the internal arm portion 223.

An extent of the receiving hole 25 in the circumferential direction is greater than an extent of the insertion hole in the circumferential direction, which prevents over-rotation of the rotatable member 30 and provides stably rotation of the actuating member 20.

Each of the two pins has a hook portion 35 which is engaged with the actuating member 20. Specifically, the adjustable tightening device 1 further includes a restoring mechanism 50, the restoring mechanism 50 includes a joint member 51 and a resilient member 52. The joint member 51 is disposed through the rotatable member 30 and the actuating member 20, and configured to be connected with a back frame 2. The rotatable member 30 is movable relative to joint member 51 so that the hook portion 35 is co-movable with the actuating member 20 to close to or away from the fastening mechanism 10. The resilient member 52 is elastically abutted against and between the joint member 51 and the rotatable member 30. Specifically, the rotatable member 30 has a post 33, the actuating member 20 has an axle hole 24, the post 33 is disposed through the axle hole 24, and the post 33 has a receiving recess 34 receiving the resilient member 52. The resilient member 52 is abutted elastically against and between the receiving recess 34 and the joint member 51 so that the actuating member 20 can be hooked out of the annular gearing portion 13 and can elastically return to within the annular gearing portion 13. The joint member 51 has an inserting rod, the inserting rod includes a large-diameter section 511 and a small-diameter section 512. The large-diameter section 511 is disposed entirely within the receiving recess 34, and the resilient member 52 elastically abuts against the large-diameter section 511. The small-diameter section 512 is disposed through the post 33 and the fastening mechanism 10, and the small-diameter section 512 and the fastening mechanism 10 are connected with each other via a bolt 3 so that the resilient member 52 can be elastically abutted between the small-diameter section 512 and the rotatable member 30.

Figure 11:
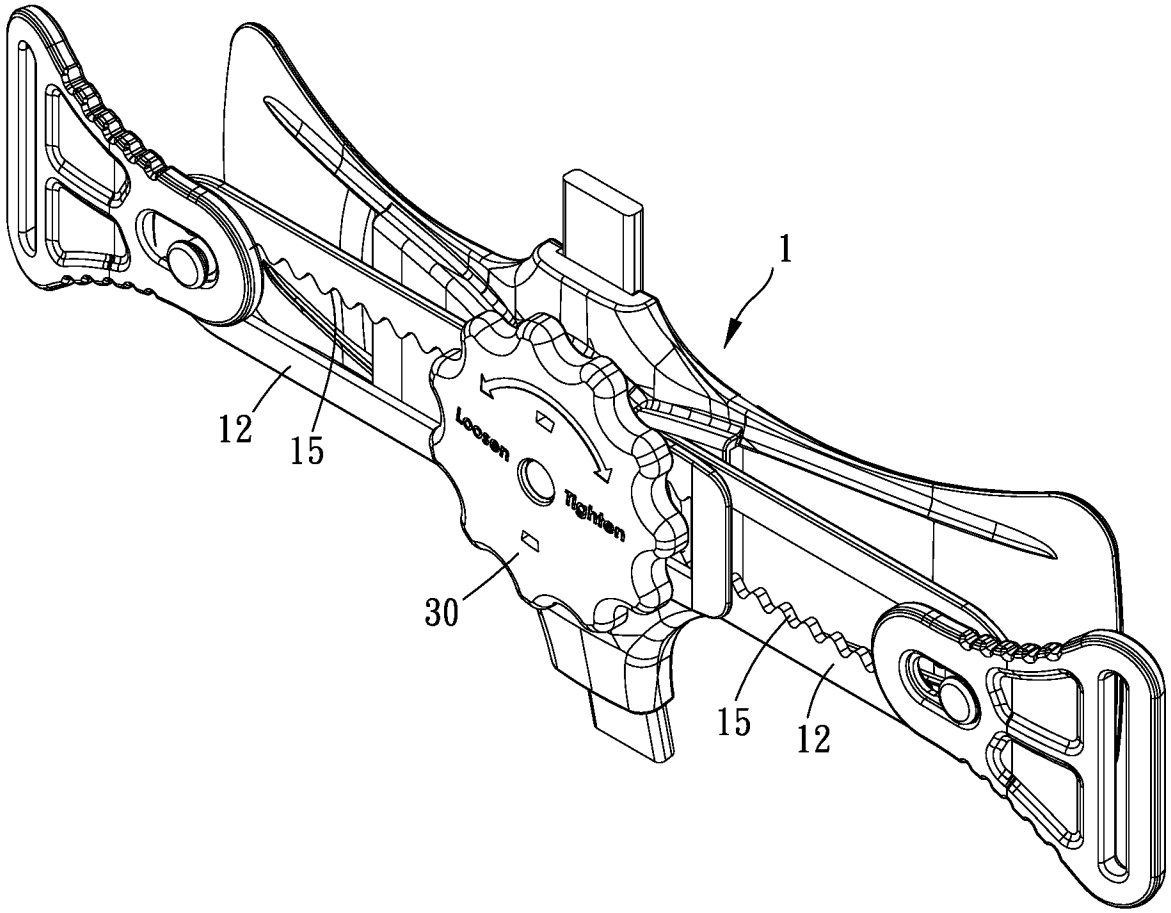
FIG. 11 is a perspective view of an adjustable tightening device according to a second preferred embodiment of the present invention.
Figure 12:
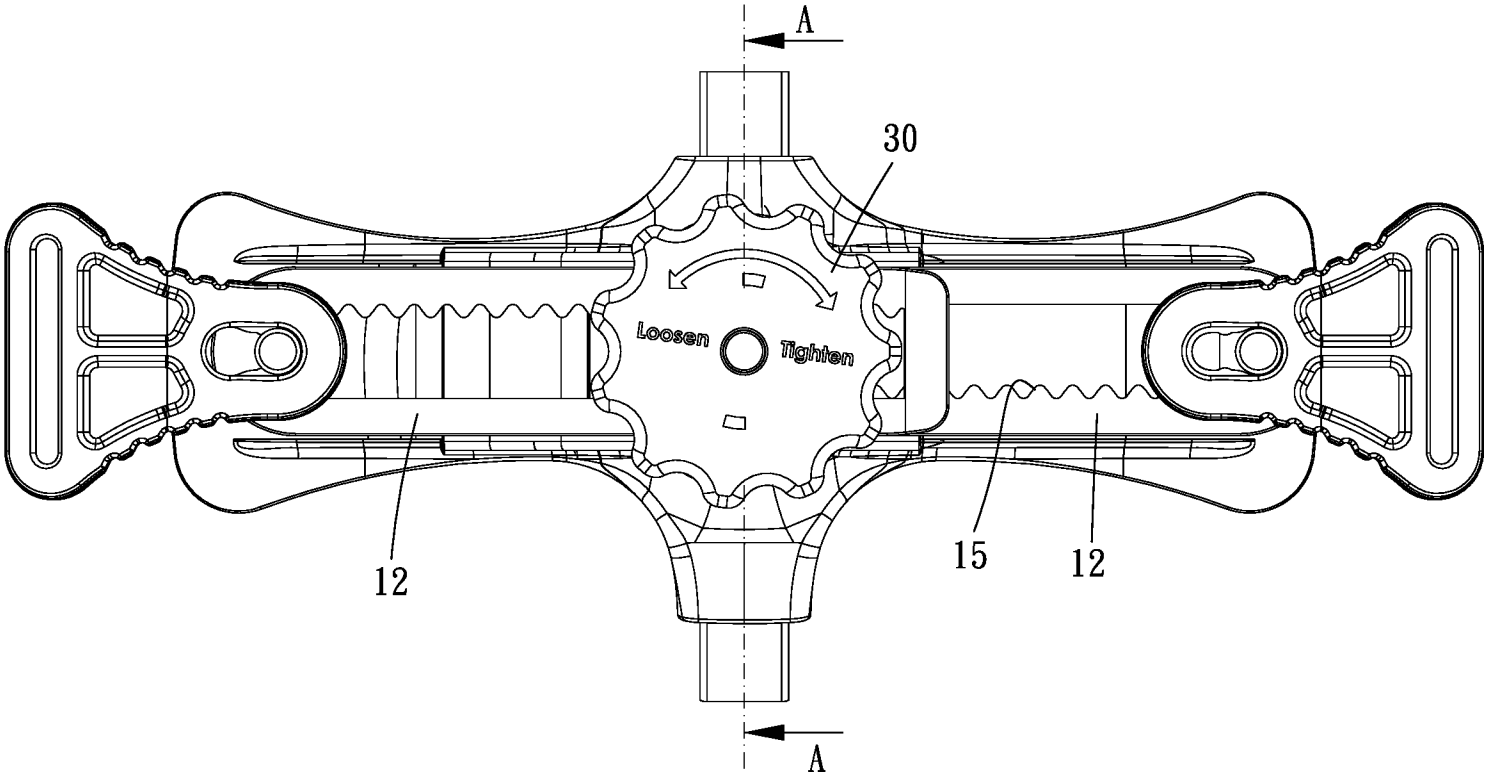
FIG. 12 is a front view of the second preferred embodiment of the present invention.
Figure 13:
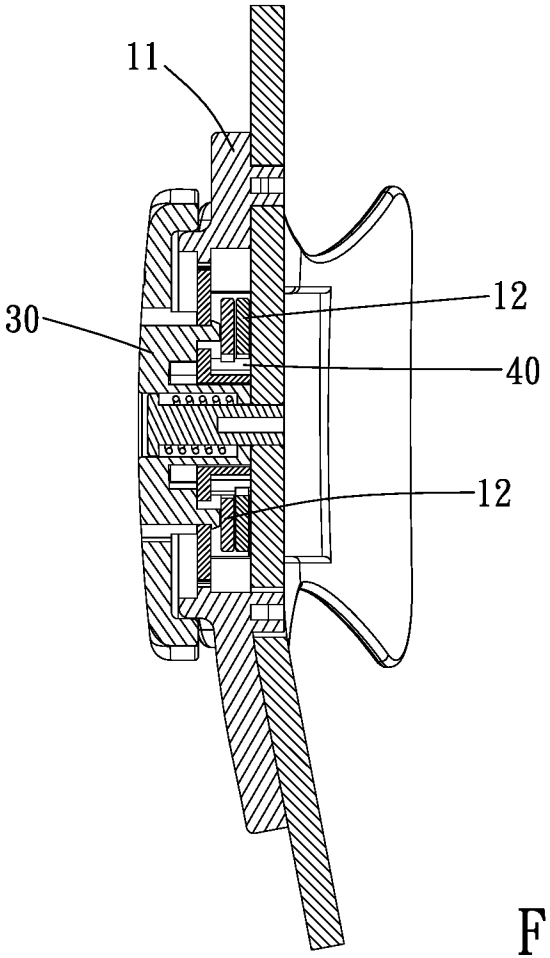
FIG. 13 is a cross-sectional view, taken along line A-A in FIG. 12.

Please refer to FIGS. 11 to 13 for a second preferred embodiment, the fastening mechanism 10 includes two said second band portion 12, and the two said second band portions 12 extend away from each other. Each of the two second bond portions 12 is positionably movable relative to the first band portion 11.

Figure 14:
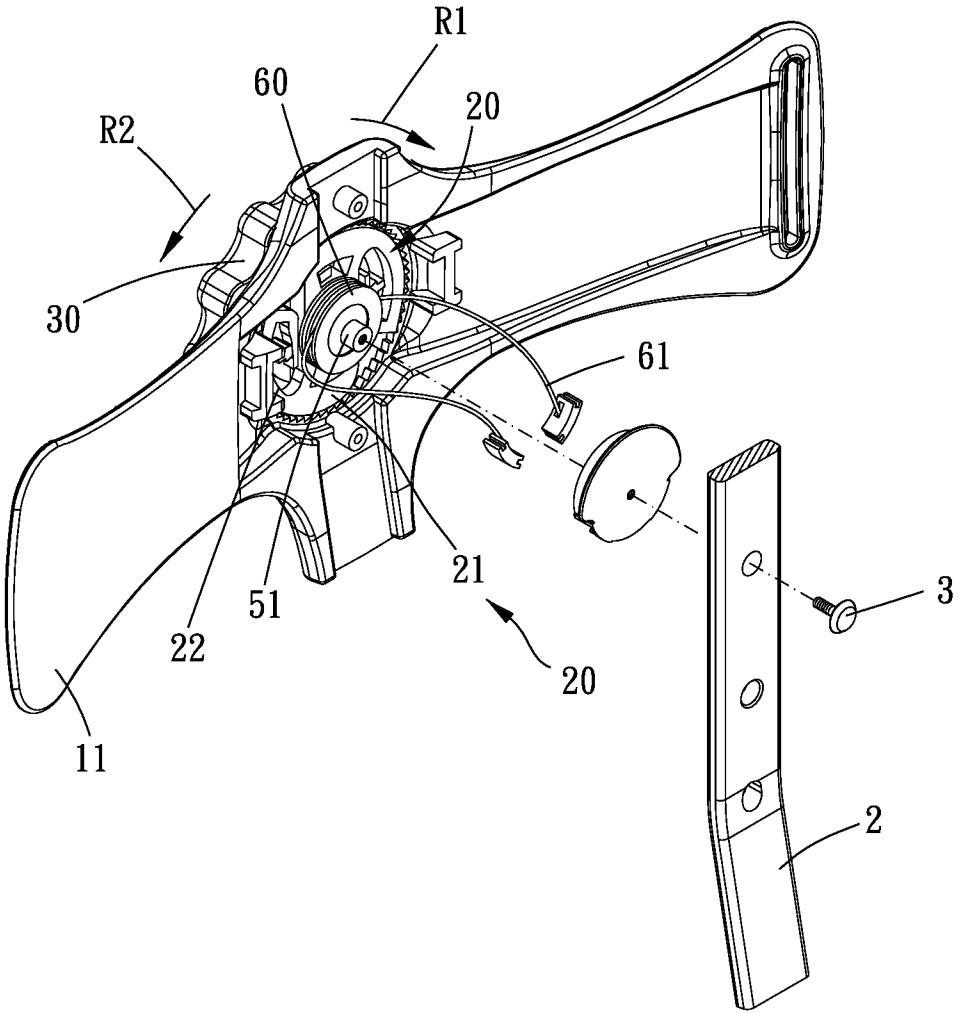
FIG. 14 is a breakdown drawing of a third preferable embodiment of the present invention.

Please refer to FIG. 14 for a third preferred embodiment, the adjustable tightening device 1 further includes a reel unit 60 connected with the central shaft portion 21 of the actuating member 20, the reel unit 60 is rotatable relative to the first band portion 11 and configured to be connected with at least one rope 61. When the rotatable member 30 is rotated toward the first direction R1, the reel unit 60 is rotatable toward the first direction R1; when the rotatable member 30 is rotated toward the second direction R2, the reel unit 60 is unidirectionally rotatable toward the second direction. Specifically, the at least one rope 61 is connected with the second band portion (not shown). Thus, the second band portion can be movable relative to the first band portion 11 by winding or unwinding the at least one rope 61.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An adjustable tightening device, including:

a fastening mechanism, including a first band portion and at least one second band portion being movable relative to the first band portion, the first band portion including a through hole having an annular gearing portion, each of the at least one second band portion having a gearing track;

an actuating member, disposed within the through hole, having a central shaft portion and two elastic arms, the central shaft portion having a gear portion protruding axially therefrom and movably meshing with the gearing track of the at least one second band portion, each of the two elastic arms radially extending away from the central shaft portion, the central shaft portion having two first restriction portions, each of two elastic arms having a ratchet disengageably meshed with the annular gearing portion, the ratchet being radially movable between a first position and a second position, each of the two first restriction portions being arranged separately from any of the two elastic arms;

a rotatable member, connected with the actuating member, including two second restriction portions and two abutting ribs, each of the two abutting ribs being movable between a third position and a fourth position and abuttable against one of the two elastic arms, each of the two first restriction portions being an insertion hole, each of the two second restriction portions being a pin which is movably inserted within one said insertion hole;

wherein when the rotatable member is rotated toward a first direction, each of the two abutting ribs is located in the third position, each of the two abutting ribs abuts against one of the two elastic arms so that the ratchet is not meshed with the annular gearing portion and the gear portion is rotatable toward the first direction; when the rotatable member is rotated toward a second direction, each of the two abutting ribs is located in the fourth position, each of the two abutting ribs abuts against one of the two elastic arms so that the ratchet is meshed with the annular gearing portion and the gear portion is unidirectionally rotatable toward the second direction;

wherein each of the two elastic arms and the central shaft portion defines a receiving hole, the receiving hole is noncommunicated with the two insertion holes, one of the two abutting ribs is engaged within one of the two receiving holes, each of the two insertion holes has two blocking walls disposed at two opposite sides thereof;

wherein when each of the two abutting ribs is located in the third position and abuts against one of the two elastic arms, each of the two pins abuts against one of the two blocking walls; when each of the two abutting ribs is located in the fourth position and abuts against one of the two elastic arms, each of the two pins abuts against the other of the two blocking walls;

wherein each of the two elastic arms has an external arm portion and an internal arm portion, a connection portion of the internal arm portion is connected with the external arm portion, the internal arm portion has a free end portion disposed opposite to the connection portion, the external arm portion has the ratchet, each said internal arm portion and one said external arm portion define one said receiving hole therebetween, one of the abutting ribs abuts against the internal arm portion, the internal arm portion has an abutted surface facing the external arm portion, the abutted surface includes a convex portion protruding toward the external arm portion, when each of the two abutting ribs is located in the third position, each of the two abutting ribs abuts against the convex portion; and when each of the two abutting ribs is located in the fourth position, each of the abutting ribs abuts against the abutted surface.

2. The adjustable tightening device of claim 1, wherein the central shaft portion of the actuating member defines an axial direction, as viewed in the axial direction, each of the two abutting ribs extends radially and is mushroom-shaped, and each said abutting rib has a head section which is abutted against the internal arm portion of one said elastic arm and a body section which is closer to the external arm portion of one said elastic arm than the head section.

3. The adjustable tightening device of claim 2, wherein the actuating member defines a circumferential direction around the axial direction, and an extent of the receiving hole in the circumferential direction is greater than an extent of the insertion hole in the circumferential direction.

4. The adjustable tightening device of claim 3, further including a restoring mechanism, the restoring mechanism including a joint member and a resilient member, the joint member being disposed through the rotatable member and the actuating member, and configured to be connected with a back frame, the rotatable member being movable relative to the joint member so that the hook portion is co-movable with the actuating member to close to or away from the fastening mechanism, and the resilient member elastically abutted against between the joint member and the rotatable member.

5. The adjustable tightening device of claim 4, wherein the free end portion extends away from the connection portion, and an extent of the internal arm portion is greater than ½ an extent of the external arm portion in the circumferential direction; the central shaft portion of the actuating member defines an axial direction, a center of the actuating member is located on the axial direction, the two elastic arms are disposed by two opposite sides of the axial direction, and the two abutting ribs are disposed by two opposite sides of the axial direction; the joint member is an inserting rod, and the inserting rod includes a large-diameter section and a small-diameter section; the large-diameter section is disposed entirely within the receiving recess, and the resilient member elastically abuts against the large-diameter section; the small-diameter section is disposed through the post and the fastening mechanism, and the small-diameter section and the fastening mechanism are connected with each other via a bolt.

6. The adjustable tightening device of claim 1, wherein the central shaft portion of the actuating member defines an axial direction, as viewed in the axial direction, each of the two abutting ribs extends radially and is mushroom-shaped, and each said abutting rib has a head section which is abutted against the internal arm portion of one said elastic arm and a body section which is closer to the external arm portion of one said elastic arm than the head section.

7. The adjustable tightening device of claim 1, wherein each of the two pins has a hook portion which is engaged with the actuating member.

8. The adjustable tightening device of claim 7, wherein the rotatable member has a post, the actuating member has an axle hole, the post is disposed through the axle hole, the post has a receiving recess receiving the resilient member, and the resilient member is abutted elastically against and between the receiving recess and the joint member.

9. The adjustable tightening device of claim 1, wherein the fastening mechanism includes two said second band portions, and the two said second band portions extend away from each other.

* * * * *